US005460930A

United States Patent [19]

Merkel et al.

[11] Patent Number: 5,460,930

[45] Date of Patent: Oct. 24, 1995

[54] PHOTOGRAPHIC ELEMENTS CONTAINING INDOANILINE DUMMY DYES

[75] Inventors: Paul B. Merkel; Jerrold N. Poslusny; Robert J. Ross, all of Rochester, N.Y.

[73] Assignee: Eastman Kodak Company, Rochester, N.Y.

[21] Appl. No.: 144,860

[22] Filed: Oct. 28, 1993

[51] Int. Cl.[6] ..... G03C 1/46

[52] U.S. Cl. ..... 430/504; 430/507; 430/510; 430/517; 430/522; 430/559

[58] Field of Search ..... 430/504, 507, 430/510, 517, 522, 559

[56] References Cited

U.S. PATENT DOCUMENTS

| | | | |
|---|---|---|---|
| 3,503,744 | 3/1970 | Itano et al. | 96/89 |
| 3,547,640 | 12/1970 | Beckett et al. | 96/74 |
| 3,622,337 | 11/1971 | Altavilla et al. | 96/100 |
| 3,647,452 | 3/1972 | Hendess et al. | 96/55 |
| 4,029,503 | 6/1977 | Fujiwhara et al. | 96/29 |
| 4,746,600 | 5/1988 | Watanabe et al. | 430/505 |
| 4,756,993 | 7/1988 | Kitatani et al. | 430/522 |
| 4,801,525 | 1/1989 | Mihara et al. | 430/518 |
| 4,957,853 | 9/1990 | Kobayashi et al. | 430/304 |
| 5,075,205 | 12/1991 | Inagaki | 430/522 |
| 5,104,774 | 4/1992 | Ohki et al. | 430/372 |
| 5,108,883 | 4/1992 | Matejec et al. | 430/507 |
| 5,132,438 | 7/1992 | Bach et al. | 552/295 |
| 5,312,723 | 5/1994 | Harada et al. | 430/507 |
| 5,312,724 | 5/1994 | Harada et al. | 430/507 |

FOREIGN PATENT DOCUMENTS

| | | |
|---|---|---|
| 449109 | 10/1991 | European Pat. Off. . |
| 2454329 | 5/1975 | Germany . |
| 60-239289 | 11/1985 | Japan . |
| 63-003062 | 6/1986 | Japan . |
| 3168742 | 7/1991 | Japan . |
| 1142509 | 2/1969 | United Kingdom . |
| 88/02699 | 4/1988 | WIPO . |

*Primary Examiner*—Charles L. Bowers, Jr.
*Assistant Examiner*—Geraldine Letscher
*Attorney, Agent, or Firm*—Gordon M. Stewart

[57] ABSTRACT

A photographic element comprising a cyan dummy dye present in the element prior to exposure and development, the dye having the formula:

wherein:

R1 is an alkoxy group, a phenoxy group or a halogen;

R2 is selected from the group consisting of an alkyl group, a phenyl group; a halogen when R1 is an alkoxy or phenoxy group; an alkoxy carbonyl group of formula —COOR7; a carbonamido group of formula —NR8COR7; and hydrogen, when R1 is a branched or substituted alkoxy or a substituted phenoxy;

R3 is hydrogen or an alkyl group;

R4 is hydrogen, or an alkyl group;

R5 is hydrogen or an alkyl group;

R6 is an alkyl group.

R7 is an alkyl group or a phenyl group;

R8 is hydrogen or an alkyl group.

Dummy dyes of the above specified type are advantageous in elements of the present invention in having good hues, good resistance to fading in weak or seasoned bleach solutions, and having good resistance to hue and density changes in cold storage.

35 Claims, No Drawings

PHOTOGRAPHIC ELEMENTS CONTAINING INDOANILINE DUMMY DYES

FIELD OF THE INVENTION

This invention relates to photographic elements containing specific indoaniline cyan dyes.

BACKGROUND OF THE INVENTION

Modern color negative films usually contain dyes coated in one or more layers for a variety of purposes. In addition to being utilized for spectral sensitization, dyes may be used for filtering specific wavelengths of exposing light (either as intergrain absorbers or in separate layers containing no silver halide), for antihalation and to adjust the background density (Dmin) of color negative films for printing purposes. Such preformed coated dyes (that is, dyes which are present in the element prior to exposure and development) are often referred to as "dummy dyes" to distinguish them from dyes that may be formed photographically as a result of exposure and chromogenic development.

In the development of color photographic elements, bleach solutions are used to oxidize developed silver to silver ions for subsequent removal in fix solution by formation of soluble silver complexes. The bleach and fix solutions are sometimes combined into a single "blix" solution. Bleach solutions commonly contain complexes of ferric ion, such as ferric ethylenediaminetetraacetic acid (EDTA), as oxidizing agents. Prolonged use of such solutions for processing of photographic film can result in accumulation of substantial quantities of the corresponding ferrous ion complexes (such as ferrous EDTA), which can function as reducing agents. These reducing agents can cause reductive discoloration of dummy dyes (so called leuco dye formation). The formation of leuco dye in such seasoned bleaches is undesirable, not only because the resulting Dmin density provided by the dummy dye will be less than the optimum required for proper printing characteristics, but also because variabilities in Dmin can occur as seasoning of a bleach progresses.

Many cyan dyes that have been used in color negative films for antihalation and for Dmin adjustment have suffered from a number of deficiencies, including loss of color in seasoned photographic bleach solutions or in bleaches of low oxidizing strength. Additionally, they may also have improper hue or suffer from changes in hue and/or density upon storage at low or high temperatures. For example, the dye of structure C1 has been used extensively in a number of commercial color negative films. The hue of this dye is suitable for Dmin adjustment and for antihalation purposes. However, dye C1 can undergo reductive discoloration when films containing it are processed in seasoned photographic bleaches or in bleaches of weak oxidizing power.

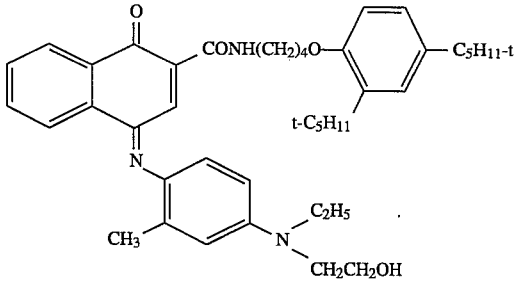

$C_1$

Thus, there has been a need to find replacements for such dyes, particularly cyan dyes, which replacements would exhibit improved properties, including less tendency to undergo leuco dye formation in seasoned bleaches or weak bleaches while retaining the desired spectral properties of dummy dyes such as dye C-1.

SUMMARY OF THE INVENTION

The present invention therefore provides photographic elements containing specific indoaniline dummy dyes to improve printing characteristics and for antihalation. Specifically the present invention provides a photographic element comprising a cyan dummy dye present in the element prior to exposure and development, the dye having the formula:

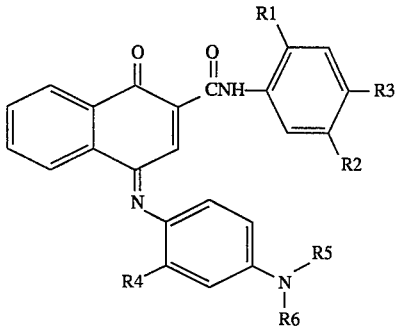

wherein:

R1 is an alkoxy group, a phenoxy group or a halogen (such as fluorine, chlorine, bromine, iodine);

R2 is selected from the group consisting of an alkyl group, a phenyl group; a halogen when R1 is an alkoxy or phenoxy group; an alkoxy carbonyl group of formula —COOR7; a carbonamido group of formula —NR8COR7; and hydrogen, when R1 is a branched or substituted alkoxy or a substituted phenoxy;

R3 is hydrogen or an alkyl group (preferably unsubstituted);

R4 is hydrogen, or an alkyl group;

R5 is hydrogen or an alkyl group (preferably unsubstituted);

R6 is an alkyl group.

R7 is an alkyl group or a phenyl group (preferably substituted);

R8 is hydrogen or an alkyl group.

The above cyan indoaniline dummy dyes in the photographic materials of the present invention have excellent hues, show improved resistance to fading in weak or seasoned bleach solutions, and show surprising resistance to hue and density changes on cold storage.

The present invention also provides a method of making photographic elements of the foregoing type.

DETAILED DESCRIPTION OF THE EMBODIMENTS OF THE INVENTION

The photographic elements of this invention comprise one or more of the nondiffusing cyan dummy dyes of the formula above, in one or more layers that are preferably under at least one red sensitive layer of a multilayer film. The dummy dye may be, for example, in a layer adjacent to and on either side of the support. By reference to "under", "above", "below" or the like terms in relation to layer structure of a photographic element, is meant the relative position in relation to light to when the element is exposed in a normal manner. "Above" would mean closer to the light source when the element is exposed normally, while "below" would mean further from the light source. Since a typical photographic element has the various layers coated on a support, "above" would mean further from the support, while "below" or "under" would mean closer to the support. In addition, the use of the word "group" in reference to alkyl group, alkoxy group, phenoxy group, or other substituent, refers to that substituent as either unsubstituted or substituted and, where possible, includes branched and unbranched moieties unless stated to the contrary.

R1 in the above formula may optionally be restricted to an unbranched alkoxy group (which itself may be restricted to unbranched and unsubstituted alkoxy), a phenoxy group or a halogen. As to R2 and R3, these may be selected so that they are not both hydrogen when R1 is a branched alkoxy group or a substituted alkoxy. Additionally, the dummy dye may be selected so as to not have any acid or acid salt groups present (such as —$SO_3H$, —COOH or their salts). In particular, R1, R2 and R3 may be selected such that they do not have an an acid or acid salt group present (particularly, they do not have —$SO_3H$, —COOH or their salts present). Alternatively, R1 may be an alkoxy group (which by the definition above, includes both branced and unbranched groups) while R2 is an unsubstituted alkyl and R3 is hydrogen.

To produce a nondiffusable dye of low water solubility, the total number of carbon atoms in R1, R2 and R3 taken together should be at least 8 and preferably from 10 to 30. Preferably R4 is methyl, R5 is ethyl and R6 is either ethyl, beta-hydroxyethyl or beta-(methylsulfonamido)ethyl, since then the dye may be synthesized from commonly used developing agents.

The photographic elements of this invention can have the indoaniline cyan dummy dyes of the type described above, incorporated in them by first dispersing an oil phase containing the dye in an aqueous phase containing a binder, such as gelatin, and one or more surfactants. The dye-containing dispersion is then coated in the appropriate layer of a multilayer film on a suitable support. The oil phase usually consists of the dye dissolved in one or more high-boiling solvents. This is typically added to an aqueous solution of gelatin and surfactant, which is followed by milling or homogenization of the mixture to disperse the oil phase in the aqueous phase as small droplets. Removable (by washing or evaporation) auxiliary solvents, such as ethyl acetate or cyclohexanone, may also be used in the preparation of such dispersions to facilitate dissolution of the dye in the oil phase.

High-boiling solvents useful for the practice of this invention include aryl phosphates (e.g. tritolyl phosphate), alkyl phosphates (eg. trioctyl phosphate), mixed aryl alkyl phosphates (e.g. diphenyl 2-ethylhexyl phosphate), aryl, alkyl or mixed arylalkyl phosphonates, phosphine oxides (e.g. trioctylphosphine oxide), esters of aromatic acids (e.g. dibutyl phthalate), esters of aliphatic acids (eg. dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl-)sulfoxide), sulfonamides (e.g. N,N-dibutyl-p-toluenesulfonamide) or hydrocarbons (e.g. dodecylbenzene). Additional high-boiling solvents and auxiliary solvents are noted in *Research Disclosure I* (referenced below), December 1989, Item 308119, p 993. Useful dye:high-boiling solvent weight ratios range from about 1:0.1 to 1:10, with 1:0.3 to 1:5.0 being preferred.

The above described cyan indoaniline dummy dyes may be coated in the photographic elements of this invention either alone in one or more layers or together with other dyes or addenda in the same layer or layers. In the photographic elements of this invention the cyan indoaniline dyes are preferably coated under at least one of the red-sensitive layers in a multilayer film. It is most common to coat these cyan dummy dyes in a layer adjacent to the transparent film support and under all of the red-sensitive layers of a multilayer film. However, the described indoaniline cyan dummy dyes may also be coated on the side of the support opposite the side on which the light-sensitive emulsion-containing layers are coated. In photographic elements of the present invention, the above described cyan indoaniline dummy dyes may also be coated in one or more of the lower silver halide containing red-sensitive layers of a multilayer film containing more than one red-sensitive layer. Useful coated levels of the cyan indoaniline dummy dyes of this invention range from about 0.002 g/sq m to 0.150 g/sq m, with coated levels ranging from 0.004 g/sq m to 0.050 g/sq m being preferred ("sq m"=square meter).

To make photographic elements of the present invention, a layer containing a cyan dummy dye of the above described type is formed. Preferably, as described above, at least one red-sensitive layer is preferably formed above the cyan dummy dye containing layer, which red-sensitive layer contains a cyan dye forming coupler which forms a cyan dye upon exposure and processing of the element. In a known manner, further layers or additives may be provided in the photographic element as described herein or which are known.

Examples of nondiffusible indoaniline cyan dummy dyes of this invention include but are not limited to the following (D1–D24):

$D_1$

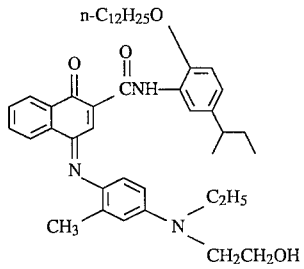

$D_2$

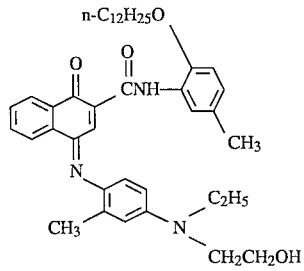

-continued
D3
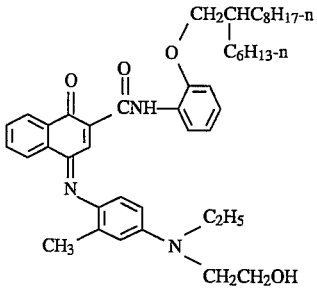
D4
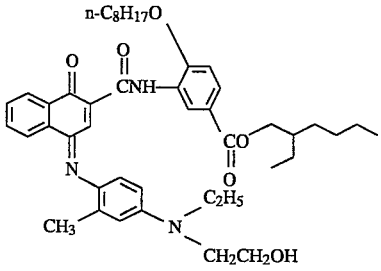
D5
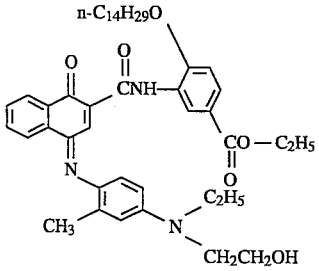
D6
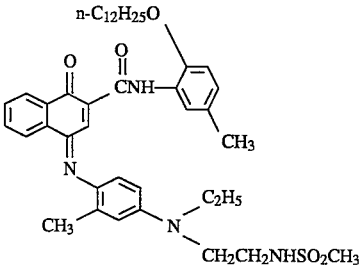
D7
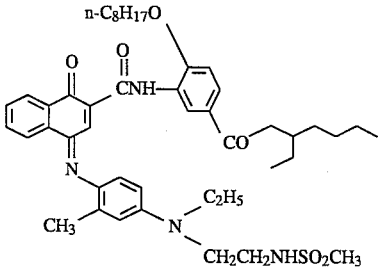
D8
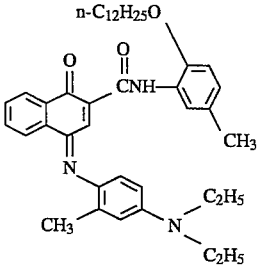
-continued
D9
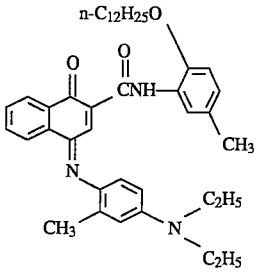
D10
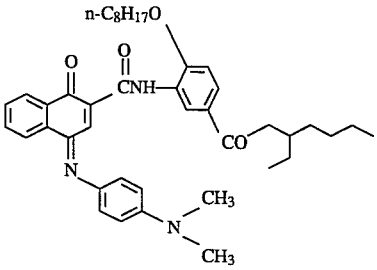
D11
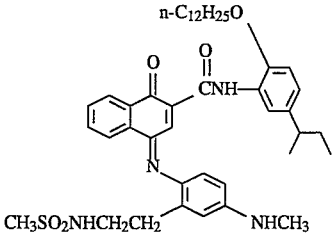
D12
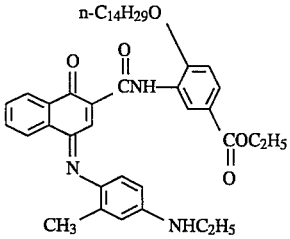
D13
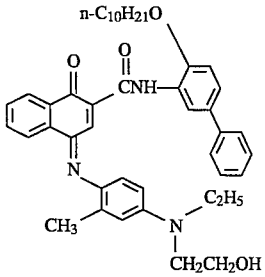
D14
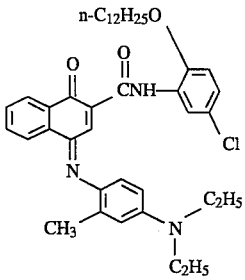

-continued

D15

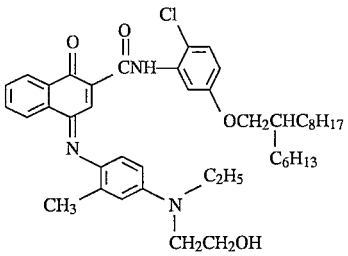

D16

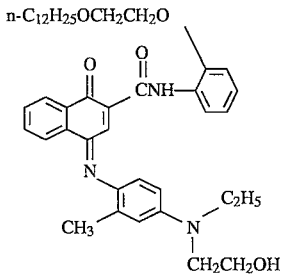

D17

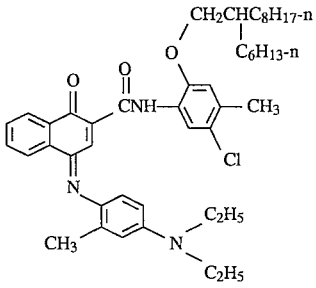

D18

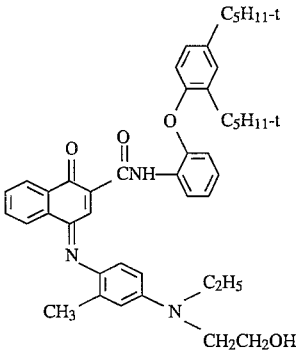

D19

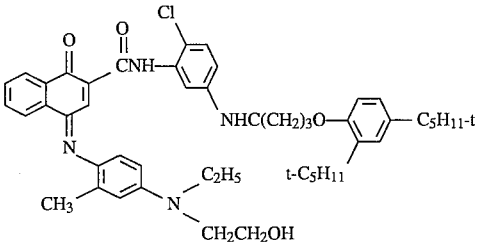

-continued

D20

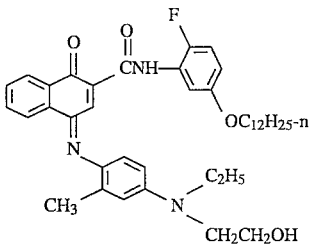

D21

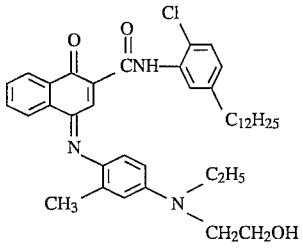

D22

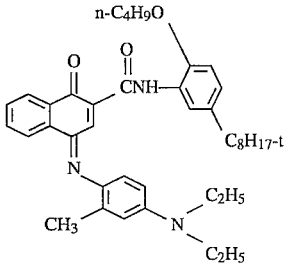

D23

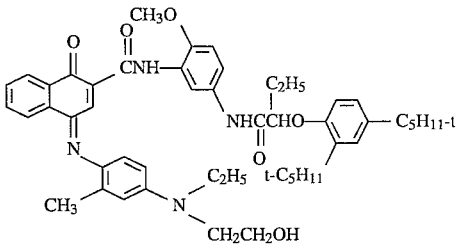

D24

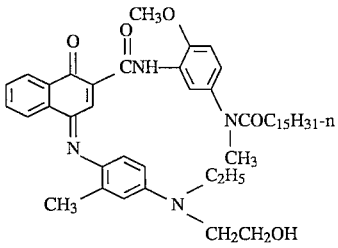

The photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643, 965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019, 492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148, 022; 3,148,062; 3,227,554; 3,384,657; 3,379,529; 3,615, 506; 3,617,291; 3,620,746; 3,701,783; 3,733,201; 4,049, 455; 4,095,984; 4,126,459; 4,149,886; 4,150,228; 4,211, 562; 4,248,962; 4,259,437; 4,362,878; 4,409,323; 4,477, 563; 4,782,012; 4,962,018; 4,500,634; 4,579,816; 4,607, 004; 4,618,571; 4,678,739; 4,746,600; 4,746,601; 4,791, 049; 4,857,447; 4,865,959; 4,880,342; 4,886,736; 4,937, 179; 4,946,767; 4,948,716; 4,952,485; 4,956,269; 4,959, 299; 4,966,835; 4,985,336 as well as in patent publications GB 1,560,240; GB 2,007,662; GB 2,032,914; GB 2,099, 167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072, 634; 90-077,822; 90-078,229; 90-78,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micron) tabular grains. To achieve the lowest levels of granularity it is preferred to that aim tabular grain projected areas be satisfied with ultrathin (t<0.06 micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVIII. This typically involves exposure to light in the visible region of the spectrum.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977. In the case of processing a reversal color element, the element is first treated with a black and white developer followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The above described nondiffusing cyan dummy dyes for photographic elements of the present invention, may be prepared from commonly used developing agents and the corresponding naphthol compound in a known manner. For example, preparation of indoaniline dye (D2) of this invention from a 2-phenylcarbamoyl-1-naphthol coupler is illustrated schematically below, and described in detail in the subsequent paragraphs.

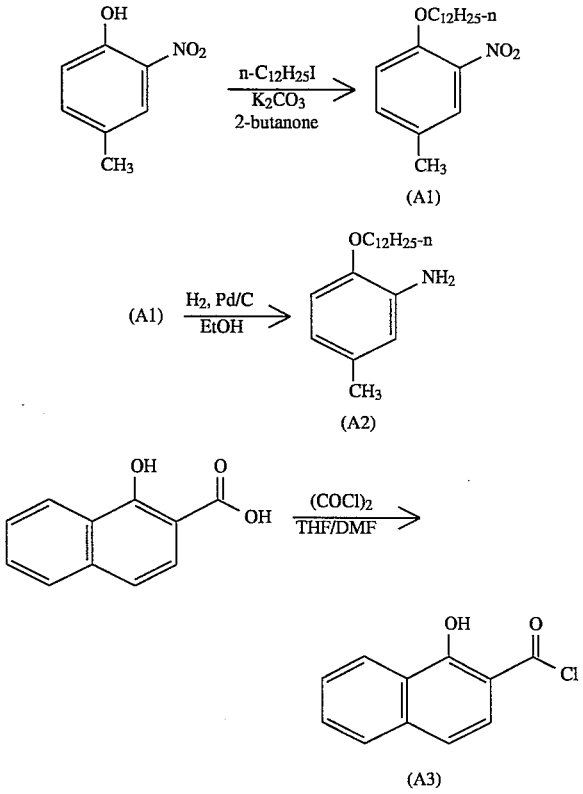

-continued

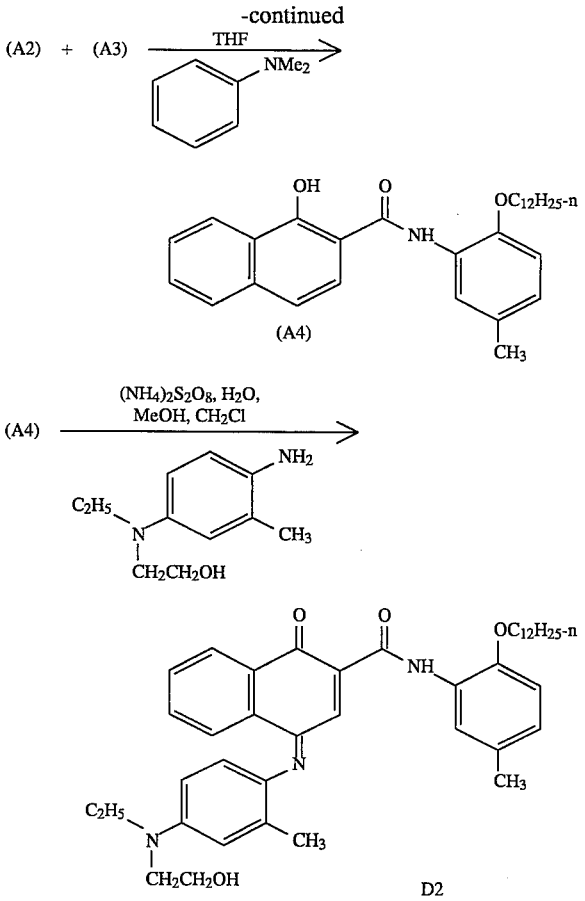

Compound (A1):

A mixture of 4-methyl-2-nitrophenol (50.0 g, 0.33 mol), 1-iodododecane (94.8 g, 0.32 mol), potassium carbonate (220.0 g, 1.6 mol) and 2-butanone (700 mL) was stirred and heated to reflux overnight. The mixture was then cooled to room temperature and poured into water, and the resulting aqueous mixture was extracted with ether. Ether extracts were combined and washed with water. The extract was then dried with magnesium sulfate and filtered. The solvent was removed on a rotary evaporator giving 96.0 g of compound (A1) as an oil (91% yield).

Compound (A2):

Compound (A1) was dissolved in 500 mL of ethanol and a catalytic amount of palladium on charcoal was added. The mixture was shaken for 18 hours under a hydrogen atmosphere (3 atm). The catalyst was removed by filtration through Celite, and the solvent was then removed under reduced pressure. The resulting reddish oil was chromatographed on a silica gel column using 95:5 ligroin:ethyl acetate as the eluant. Upon solvent evaporation, 64.0 g of (A2) was obtained as a yellow oil (73%).

Compound (A3):

A 12.9 g (0.069 mol) quantity of 1-hydroxy-2-naphthoic acid was dissolved in 250 mL of tetrahydrofuran containing 2 drops of N,N-dimethylformamide as a catalyst. Oxalyl chloride (6.6 mL, 0.076 mol) was added dropwise. The reaction mixture was stirred for one hour, at which point all gas evolution had ceased. The solvent was removed on a rotary evaporator yielding (A3), which was used immediately without further purification.

Compound (A4):

Compound (A3) was redissolved in 150 mL of tetrahydrofuran. A solution of 20 g (0.069 mol) of (A2) in 9.7 mL (0.076 mol) of N,N-dimethylaniline was then added. The reaction mixture was stirred overnight at ambient temperature and then poured into a solution of dilute hydrochloric acid. The aqueous mixture was extracted with ethyl acetate, and the extracts were dried over magnesium sulfate and filtered. The filtrate was concentrated to an oil, which was dissolved in ligroin and then filtered to remove some insoluble material. The product was eluted through a silica gel column using ethyl acetate. The resulting oil was slurried in ether/ligroin and filtered to give 10.3 g (32%) of (A4) as a light yellow solid.

A solution of 20.0 g (0.088 mol) of ammonium persulfate (Kodak) in 40 mL of water was added over a 30 min period to a rapidly stirred solution containing 17.2 g (0.037 mol) of coupler (A4), 33 mL of triethylamine (Kodak) and 12.8 g (0.044 mol) of 4-(N-ethyl-N-2-hydroxyethyl)-2-methylphenylenediamine sulfate (Kodak) in 300 mL of dichloromethane and 200 mL of methanol at 20°–25° C. The deep blue solution was stirred for 3 hr at ambient temperature and was then diluted with 300 mL of dichloromethane and extracted with three 500 mL portions of water. The blue organic phase was dried over sodium sulfate, filtered and concentrated under vacuum to provide a blue solid. The solid was dissolved in 150 mL of dichloromethane and added to 500 mL of boiling methanol over 15 min with rapid stirring. A bronze-colored precipitate formed. After the solution had cooled to room temperature 20.7 g (86% yield) of dye D2 (MP=113°–115° C.) was collected by filtration. The absorption maximum of dye D2 in acetonitrile was measured as 691 nm.

Combustion Analysis: Theoretical 75.5% C, 8.2% H and 6.5% N; Found 75.2% C, 8.3% H and 6.3% N The advantages of using the above described specific indoaniline cyan dummy dyes in photographic elements of this invention are illustrated in the following comparative Examples. These Examples illustrate that, in comparison to dyes of the prior art, the indoaniline cyan dyes of this invention show reduced density losses in seasoned bleaches, while maintaining the desired hue and resisting density losses on cold storage. The high-boiling solvents S1 and S2 in these Examples, refer to tritolyl phosphate (mixed isomers) and dibutyl phthalate, respectively. References are to parts by weight, unless otherwise indicated.

EXAMPLE 1

Illustration of the Advantageous Properties of the Indoaniline Cyan Dyes of this Invention in a Simplified Test Format In this example, single-layer dye coatings were prepared and evaluated with respect to dye hue, resistance to leuco dye formation in a seasoned bleach solution and dye crystallization on cold storage. Dyes D1, D2, D3 and D19 of this invention were coated along with comparative dyes C1, C2 and C3, whose structures are shown below. All of the dyes were dispersed with the high-boiling solvent S1 at a 1:1 weight ratio. In addition, dyes C1 and D2 were dispersed with the high-boiling solvent S2 at a 1:2 dye:solvent weight ratio.

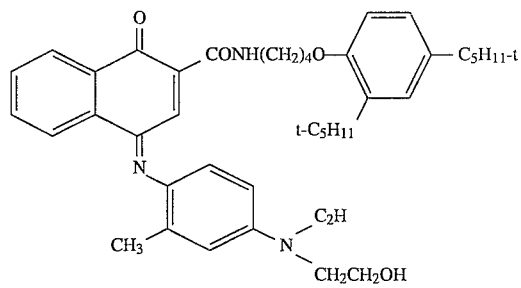

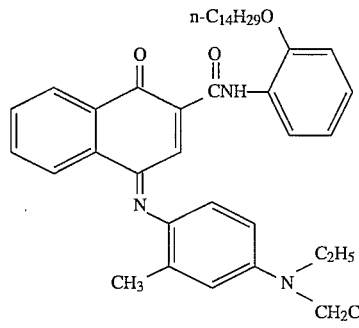

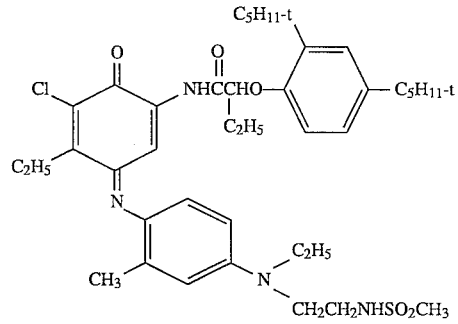

To prepare the dispersions, an oil phase consisting of 0.07 g of dye, 0.07 g of S1 (or 0.14 g of S2) and 1.6 ml of ethyl acetate was added to an aqueous phase consisting of 1.0 g of gelatin and 0.1 g of a surfactant (sodium tri-isopropylnaphthalene sulfonate) in 19.9 ml of water. The oil phase was dispersed in the aqueous phase in the form of small particles by passing the mixture through a colloid mill in a manner known in the art. After adding a spreading agent and formaldehyde hardener (0.0075 g) the dispersion was coated at a laydown of 0.10 L/sq m, yielding a dye laydown of about 0.31 g/sq m and a gelatin laydown of about 4.4 g/sq m. The ethyl acetate auxiliary solvent evaporated from the coatings on drying.

After hardening, the coatings were washed for 5 min at 25° C., dried and the dye absorption spectra were measured on a Sargent-Welch PU8800 spectrophotometer. To test the propensity for reduction of the cyan dyes to their leuco forms in weak or seasoned bleaches a simple test was designed to simulate the bleach step of photographic process, such as the C-41 process. After recording the absorption spectra, the dye- containing films were first placed for three minutes in a solution consisting of 50 mL of water, 50 mL of fresh Bleach II used in the C-41 process, 2.0 g of ferrous sulfate heptahydrate, 2.5 g of the dipotassium salt of (ethylenedinitrilo)tetraacetic acid (EDTA) and 1.5 mL of ammonium hydroxide reagent. The pH of the solution was adjusted to 4.75 with acetic acid prior to immersion of the film samples. This procedure simulates the early stages of the C-41 bleach process, in which ferrous ion concentrations are quite high due to reduction of iron EDTA upon oxidation of developed silver. Then the films samples were placed for four minutes in a solution consisting of 100 mL of fresh C-41 Bleach II, 1.0 g/L of ferrous sulfate heptahydrate and 0.2 g/L of dipotassium EDTA adjusted to a pH of 4.75. This simulates the ferrous ion levels and acidity of seasoned bleaches actually observed in seasoned processing solutions encountered in trade laboratories. The films were then washed and dried, and their spectra were remeasured. The percentage losses in density at lamda max due to leuco cyan dye formation are also listed in Table I along with the wavelengths of maximum absorption.

Dyes similar to those of this invention sometimes show undesirable changes in hue and density, when films containing them are exposed to low temperatures. This is usually due to crystallization of the dyes on cold storage to produce a form with a markedly different absorption spectrum than the dissolved or amorphous forms. To test the tendency for the dyes of this invention to undergo such changes, the film spectra were also measured after storage for 48 hr at −18° C. The percentage density losses at the absorption maximum ($\lambda_{max}$) resulting from cold storage are also listed in Table I.

TABLE I

| DYE | SOLVENT | ABSORPTION MAXIMUM (nm) | (LCD TEST) % DENSITY LOSS IN SIMULATED SEASONED BLEACH | (FREEZER TEST) % DENSITY LOSS AT $\lambda_{max}$ 48 HR @ −18° C. |
|---|---|---|---|---|
| C1 | S1 (1:1) | 692 | 24.0 | 0.3 |
| C1 | S2 (1:2) | 690 | 22.5 | 0.0 |
| C2 | S1 (1:1) | 698 | 4.7 | 76.2 |
| C3 | S1 (1:1) | 658 | 16.1 | 0.0 |
| D1 | S1 (1:1) | 700 | 3.4 | 0.0 |
| D2 | S1 (1:1) | 699 | 3.4 | 3.0 |
| D2 | S2 (1:2) | 695 | 4.3 | 0.0 |
| D3 | S1 (1:1) | 701 | 2.3 | 1.2 |
| D19 | S1 (1:1) | 709 | 3.8 | 0.4 |

As is evident from the data in Table I, only the dyes D1, D2, D3 and D19 of this invention and comparative dye C2 show acceptably low losses in density in the LCD bleach test. Comparative dyes C1 and C3 undergo density losses of more than 15%. Comparative dye C2 is unacceptable because it shows a large loss in density (76%) and hue change on cold storage due to crystallization. All of the other dyes show acceptable density changes on cold storage. Even freshly coated samples of dye C2 that have not been exposed to low temperatures show some evidence of dye crystallization in the form of a shoulder in the absorption specturm at about 570 nm, corresponding to the absorption maximum of the crystalline form of the dye. Dye C3 is also unacceptable since its absorption maximum is at 658 nm, which is too hypsochromic. In most cases, the ideal absorption maximum of a dummy dye for printing purposes and for antihalation is in the region of about 685 to 710 nm, with about 690 to 705 nm being preferred. The dyes of this invention D1, D2 and D3 have absorption maxima in the preferred range. Dye D19, while acceptable, is somewhat less preferred, since its absorption maximum is at 709 nm.

EXAMPLE 2

Illustration of the Advantages of the Cyan Indoaniline Dummy Dyes of this Invention in a Multilayer Film The multilayer film structure utilized for this example is shown schematically below. Indicated laydowns are in g/sq m, unless otherwise indicated. Comparative dye C1 in Coating A was replaced by an equimolar level of dye D1 (coating B) or dye D2 (coating C) of this invention. The high-boiling solvent S2 was used at dye:solvent weight ratio of 1:5, and the dye dispersions were prepared without auxiliary solvent. Gelatin was used as a binder in the various film layers. The relevant layers in which cyan dye is varied for comparison purposes are filtration layer 1 and AHU layer 13. Spectra of Dmin (unexposed areas) of the processed films indicate that films A, B and C are nearly identical. The advantageous use of dyes D1 and D2, of this invention over dye C1 of the prior art is illustrated by the behavior of films A, B and C in a simulated seasoned bleach.

After hardening, the films were exposed through a step tablet on a 1B sensitometer and then subjected to a KODAK FLEXICOLOR C-41 process as described in more detail below. To evaluate the propensity for leuco cyan dye formation (that is, dye bleaching) in a seasoned bleach, exposed 35 mm film strips were slit in half and both halves were processed at the same time in C-41 developer. Both halves were then placed in a stop bath to eliminate any variability due to continued coupling. Then one half was processed in fresh Bleach II and the other half was processed in a simulated seasoned bleach (Bleach B). Bleach B consisted of fresh Bleach II to which was added 10.0 g/L of ferrous sulfate heptahydrate and 2.0 g/L of dipotassium EDTA dihydrate with the the bleach pH adjusted to 4.75. During processing in Bleach B, agitation was provided by nitrogen bubbling (as opposed to air bubbling for Bleach II) to minimize air oxidation of ferrous ion to ferric ion. Status M red densities (Dr) were measured vs exposure for the samples processed in fresh Bleach II and in simulated seasoned Bleach B. The red density losses observed using Bleach B compared to fresh Bleach II are given in Table II. From this data it is evident that dyes D1 and D2 of this invention yield lower density losses in a seasoned bleach throughout the exposure scale (that is, in Dmin at Dr=1.0 and at Dr=1.8) and thus offer a significant advantage in the photographic elements of the present invention over dye C1.

| MULTILAYER FILM STRUCTURE |
|---|
| 1 Overcoat Layer Containing Hardener |
| 2 UV and Filter Layer Containing a UV absorber and A) 0.0054 C1 or B) 0.0059 of D1 or C) 0.0054 of D2 |
| 3 Fast Yellow Layer Containing Yellow Imaging Couplers, a Yellow DIAR Coupler, a Bleach-Accelerator-Releasing Coupler and Silver Halide Emulsions |
| 4 Slow Yellow Layer Containing Yellow Imaging Couplers, a Yellow DIAR Coupler, a Bleach-Accelerator-Releasing Coupler and Silver Halide Emulsions |
| 5 Interlayer Containing a Bleachable Yellow Filter Dye |
| 6 Fast Magenta Layer Containing a Magenta Imaging Coupler, a Magenta DIR Coupler, a Yellow-Colored Magenta Dye-Forming Masking Coupler, a Yellow DIR Coupler, a Cyan DIAR Coupler and a Silver Halide Emulsion |
| 7 Mid Magenta Layer Containing a Magenta Imaging Coupler, a Yellow-Colored Magenta Dye-Forming Masking Coupler, a Cyan DIAR Coupler and a Silver Halide Emulsion |
| 8 Slow Magenta Layer Containing a Magenta Imaging Coupler, a Yellow-Colored Magenta Dye-Forming Masking Coupler and Silver Halide Emulsions |
| 9 Gelatin Interlayer |
| 10 Fast Cyan Layer Containing a Cyan Imaging Coupler, a Cyan DIR Coupler, a Cyan DIAR Coupler, a Magenta-Colored Cyan Dye-Forming Masking Coupler and a Silver Halide Emulsion |
| 11 Mid Cyan Layer Containing a Cyan Imaging Coupler, a Cyan DIAR Coupler, a Magenta-Colored Cyan Dye-Forming Masking Coupler and a Silver Halide Emulsion |
| 12 Slow Cyan Layer Containing a Cyan Imaging Coupler, a Cyan Bleach-Accelerator-Releasing Coupler, a Magenta-Colored Cyan Dye-Forming Masking Coupler and Silver Halide Emulsions |
| 13 Antihalation Layer Containing a Magenta Dye, a Yellow Dye, Grey Silver, an Interlayer Scavanger and A) 0.032 of C1 or B) 0.035 of D1 or 0.032 of D2 |
| Cellulose Acetate Support |

PROCESSING SOLUTIONS AND CONDITIONS

| SOLUTION | PROCESSING TIME | AGITATION GAS |
|---|---|---|
| C-41 Developer | 3'15" | Nitrogen |
| ECN Stop Bath | 30" | Nitrogen |
| A) Fresh Bleach II | 3' | Air |
| or B) Seasoned Bleach B | 3' | Nitrogen |
| Wash | 1' | None |
| C-41 Fix | 4' | Nitrogen |
| Wash | 4' | None |
| PHOTO-FLO | 30" | None |
| Processing Temperature = 100° F. | | |

TABLE II

| MULTI-LAYER FILM | DUMMY DYE | DENSITY LOSS IN BLEACH B vs BLEACH II in Dmin | at Dr = 1.0 | at Dr = 1.8 |
|---|---|---|---|---|
| A | C1 | 0.07 | 0.13 | 0.20 |
| B | D1 | 0.02 | 0.08 | 0.16 |
| C | D2 | 0.02 | 0.07 | 0.13 |

The preceding examples are set forth to illustrate specific embodiments of this invention and are not intended to limit the scope of the compositions or materials of the invention. It will be understood that variations and modifications can be effected within the spirit and scope of the invention.

What is claimed is:

1. A photographic element comprising a cyan dummy dye present in the element prior to exposure and development, the dye having the formula:

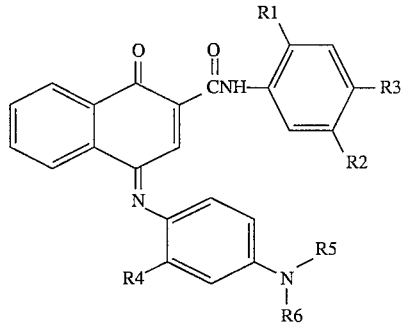

wherein:

R1 is an alkoxy group, a phenoxy group or a halogen;

R2 is selected from the group consisting of an alkyl group, a phenyl group; a halogen when R1 is an alkoxy or phenoxy group; an alkoxy carbonyl group of formula —COOR7; a carbonamido group of formula —NR8COR7; and hydrogen, when R1 is a branched or substituted alkoxy or a substituted phenoxy;

R3 is hydrogen or an alkyl group;

R4 is hydrogen, or an alkyl group;

R5 is hydrogen or an alkyl group;

R6 is an alkyl group;

R7 is an alkyl group or a phenyl group;

R8 is hydrogen or an alkyl group.

2. A photographic element according to claim 1 wherein R1 is an unbranched alkoxy group, a phenoxy group or a halogen.

3. A photographic element according to claim 1 wherein R1 is an unbranched and unsubstituted alkoxy, a phenoxy group or a halogen.

4. A photographic element according to claim 1 wherein R2 and R3 are not both hydrogen when R1 is a branched alkoxy group or a substituted alkoxy.

5. A photographic element according to claim 1 wherein R1 is an alkoxy group, R2 is an unsubstituted alkyl and R3 is hydrogen.

6. A photographic element according to claim 1 wherein R4 is methyl, R5 is ethyl and R6 is beta-hydroxyethyl, beta-(methylsulfonamido)ethyl or ethyl.

7. A photographic element according to claim 5 wherein R4 is methyl, R5 is ethyl and R6 is beta-hydroxyethyl, beta-(methylsulfonamido)ethyl or ethyl.

8. A photographic element according to claim 1 wherein R1, R2 and R3 together have a total of at least 8 carbon atoms.

9. A photographic element according to claim 1 wherein the cyan dye is of structure $D_1$ or $D_2$ below:

$D_1$

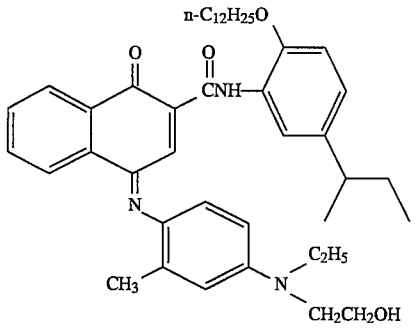

$D_2$

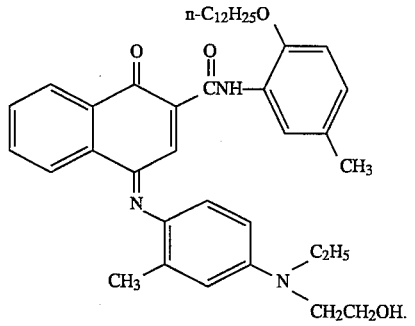

10. A photographic element comprising a red-sensitive layer containing a red-sensitive silver halide emulsion and a cyan dye forming coupler which forms a cyan dye upon exposure and processing of the element, and comprising a second layer below the red-sensitive layer which second layer contains a cyan dummy dye present in the element prior to exposure and development, the dye having the formula:

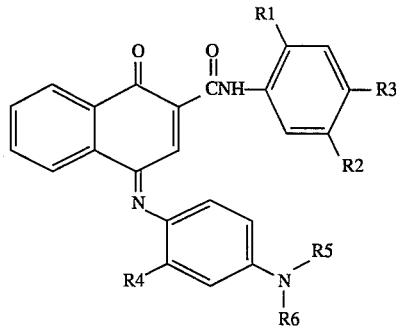

wherein:

R1 is an alkoxy group, a phenoxy group or a halogen;

R2 is selected from the group consisting of an alkyl group, a phenyl group; a halogen when R1 is an alkoxy or phenoxy group; an alkoxy carbonyl group of formula —COOR7; a carbonamido group of formula —NR8COR7; and hydrogen, when R1 is a branched or substituted alkoxy or a substituted phenoxy;

R3 is hydrogen or an alkyl group;

R4 is hydrogen, or an alkyl group;

R5 is hydrogen or an alkyl group;

R6 is an alkyl group;

R7 is an alkyl group or a phenyl group;

R8 is hydrogen or an alkyl group.

11. A photographic element according to claim 10 additionally comprising a green-sensitive layer containing a green-sensitive silver halide emulsion and a magenta dye forming coupler which forms a magenta dye upon exposure and processing of the element, and comprising a blue-sensitive layer containig a blue-sensitive silver halide emulsion and a yellow dye forming coupler which forms a yellow dye upon exposure and processing of the element.

12. A photographic element according to claim 10 wherein the cyan dummy dye is coated at a level of from 0.002 g/m$^2$ to 0.150 g/m$^2$.

13. A photographic element according to claim 10 wherein the cyan dummy dye is coated at a level of from 0.004 g/m$^2$ to 0.050 g/m$^2$.

14. A photographic element according to claim 10 wherein R1 is an unbranched alkoxy group, a phenoxy group or a halogen.

15. A photographic element according to claim 10 wherein R1 is an unbranched and unsubstituted alkoxy, a phenoxy group or a halogen.

16. A photographic element according to claim 10 wherein R2 and R3 are not both hydrogen when R1 is a branched alkoxy group or a substituted alkoxy.

17. A photographic element according to claim 10 wherein R1 is an alkoxy group, R2 is an unsubstituted alkyl and R3 is hydrogen.

18. A photographic element according to claim 10 wherein R4 is methyl, R5 is ethyl and R6 is beta-hydroxyethyl, beta-(methylsulfonamido)ethyl or ethyl.

19. A photographic element according to claim 17 wherein R4 is methyl, R5 is ethyl and R6 is beta-hydroxyethyl, beta-(methylsulfonamido)ethyl or ethyl.

20. A photographic element according to claim 10 wherein R1 is an alkoxy group, R2 is an alkoxy carbonyl group and R3 is hydrogen.

21. A photographic element according to claim 10 wherein the cyan dye is of structure $D_1$ or $D_2$ below:

$D_1$

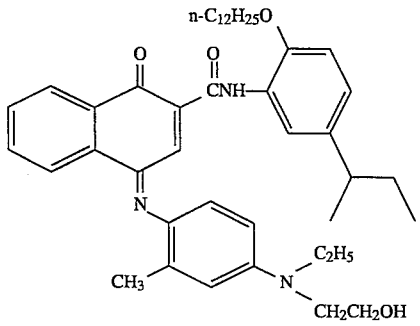

$D_2$

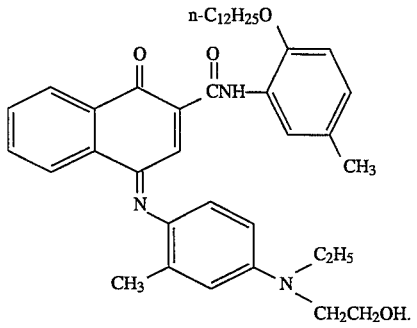

22. A photographic element according to claim 10 wherein the cyan dye is of structure $D_4$ or D5 below:

D4

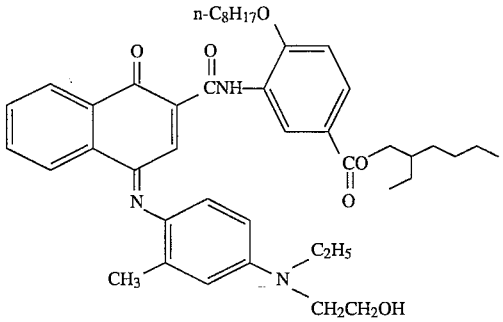

D5

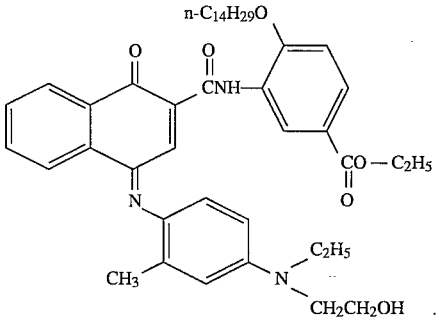

23. A photographic element according to claim 1 wherein the cyan dye is of structure D3, D13, D16 or D18 below:

D3

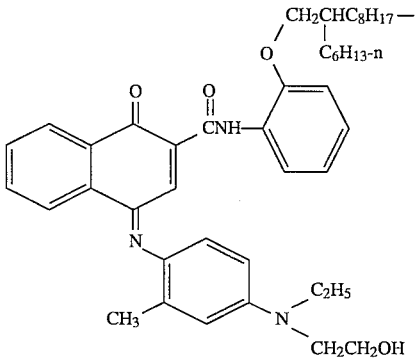

D13

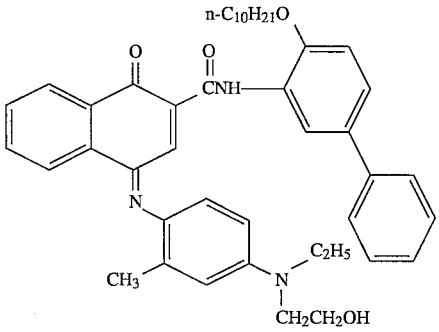

-continued

D16

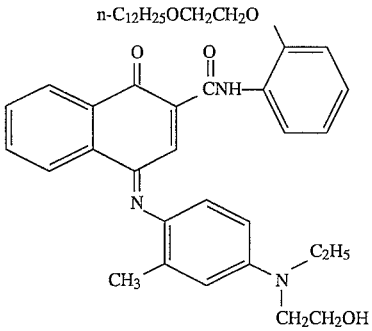

D18

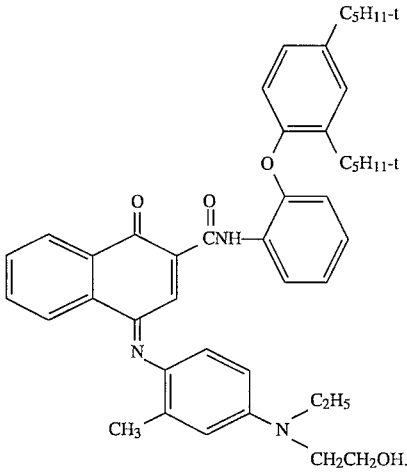

24. A photographic element according to claim 10 wherein R1, R2 and R3 together have a total of at least 10 carbon atoms.

25. A photographic element according to claim 10 wherein R1, R2 and R3 together have a total of between 10 and 30 carbon atoms.

26. A photographic element according to claim 10 wherein the cyan dummy dye is provided in the second layer in the form of dispersion of a high-boiling solvent containing the dye, and wherein the solvent is selected from dibutyl phthalate, tritolyl phosphate or N,N-dibutyl dodecanamide.

27. A method of making a photographic element comprising forming a layer containing a cyan dummy dye, the dye having the formula:

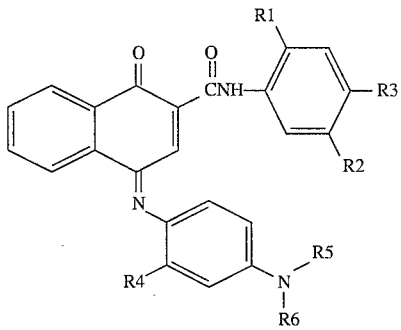

wherein:

R1 is an alkoxy group, a phenoxy group or a halogen;

R2 is selected from the group consisting of an alkyl group, a phenyl group; a halogen when R1 is an alkoxy or phenoxy group; an alkoxy carbonyl group of formula —COOR7; a carbonamido group of formula —NR8COR7; and hydrogen, when R1 is a branched or substituted alkoxy or a substituted phenoxy;

R3 is hydrogen or an alkyl group;

R4 is hydrogen, or an alkyl group;

R5 is hydrogen or an alkyl group;

R6 is an alkyl group;

R7 is an alkyl group or a phenyl group;

R8 is hydrogen or an alkyl group.

28. A method according to claim 27 additionally comprising forming a red-sensitive silver halide emulsion layer above the cyan dummy dye containing layer, which red-sensitive layer contains a cyan dye forming coupler which forms a cyan dye upon exposure and processing of the element.

29. A photographic element according to claim 28 wherein R1 is an unbranched alkoxy group, a phenoxy group or a halogen.

30. A photographic element according to claim 28 wherein R1 is an unbranched and unsubstituted alkoxy, a phenoxy group or a halogen.

31. A photographic element according to claim 1, additionally comprising at least one silver halide emulsion layer, and in which element the dummy dye is dissolved in the solvent of a solvent dispersion located in a layer of the element.

32. A photographic element according to claim 10, in which element the dummy dye is dissolved in the solvent of a solvent dispersion.

33. A photographic element according to claim 11, in which element the dummy dye is dissolved in the solvent of a solvent dispersion.

34. A photographic element according to claim 12, in which element the dummy dye is dissolved in the solvent of a solvent dispersion.

35. A photographic element according to claim 25, in which element the dummy dye is dissolved in the solvent of a solvent dispersion.

* * * * *